US006354870B1

(12) United States Patent
Timmerman

(10) Patent No.: US 6,354,870 B1
(45) Date of Patent: Mar. 12, 2002

(54) APPARATUS AND METHOD FOR MOUNTING SMALL ELECTRICAL CONNECTOR

(75) Inventor: Kenneth D. Timmerman, Lawrenceville, GA (US)

(73) Assignee: Matsushita Mobil Communication Development Corp., Suwanee, GA (US)

( * ) Notice: Subject to any disclaimer, the term of this patent is extended or adjusted under 35 U.S.C. 154(b) by 0 days.

(21) Appl. No.: 09/373,259

(22) Filed: Aug. 12, 1999

(51) Int. Cl.[7] ..... H01R 13/60
(52) U.S. Cl. ..... 439/569
(58) Field of Search ..... 439/569, 500, 439/573, 79, 607, 609

(56) References Cited

U.S. PATENT DOCUMENTS

| | | | | |
|---|---|---|---|---|
| 5,761,299 A | | 6/1998 | Patterson et al. | 379/433 |
| 5,812,660 A | * | 9/1998 | Suzuki et al. | 379/438 |
| D416,538 S | * | 11/1999 | Lok | D13/147 |
| 6,050,852 A | * | 4/2000 | Wu | 439/607 |

FOREIGN PATENT DOCUMENTS

| | | | |
|---|---|---|---|
| EP | 0 591 723 A | 4/1994 | H01R/23/02 |
| EP | 0 849 396 | 11/1996 | H01R/3/00 |
| EP | 0 810 689 | 5/1997 | H01R/9/22 |

* cited by examiner

*Primary Examiner*—Gary Paumen
*Assistant Examiner*—Phuongchi Nguyen

(57) ABSTRACT

An apparatus and method for mounting a small ruggedized electrical connector assembly to a body. In general, the electrical connector assembly comprises an insulative housing made of a first material, an electrical contact assembly, and a stiffening member made of a second material. The electrical contact assembly comprises one or more electrical contacts extending through the insulative housing. The stiffening member transfers forces from a plug inserted into the electrical connector assembly to the body instead of to the more fragile electrical contacts. The stiffening member comprises a shroud positioned adjacent to the insulative housing and plurality of mounting flanges connected to the shroud. The mounting flanges are fastened to the body and may also be layered with, and fastened to, corresponding mounting flanges integral with the to the insulative housing.

20 Claims, 4 Drawing Sheets

APPARATUS AND METHOD FOR MOUNTING SMALL ELECTRICAL CONNECTOR

TECHNICAL FIELD

This invention relates to the field of plug-type connectors and, more particularly, relates to small ruggedized plug-type connectors for use in connecting plugs to small electrical devices such as portable radio telephones.

BACKGROUND

The use of small connectors to connect cords, cables or wires to various electrical devices has been known for many years. In one typical application, such a connector is installed in a portable radio telephone. A plug capable of mating with the connector is affixed to the end of a cord in a cord/plug assembly. Because devices such as radio telephones are designed to be as portable as possible, a device's size and weight become critical design characteristics. As a result, every component of such a device is designed to help minimize the device's size and weight. In particular, it is useful for the connectors to have small profiles, sizes and weights.

While a connector is designed to be as small as possible, at the same time, the connector must also meet high durability requirements. For example, a cord/plug assembly is typically inserted into a radio telephone's connector when the telephone is placed in the "hands-free" mode of operation. This is done to recharge the battery, to connect the telephone to a speaker, or to perform other functions. When a user moves the telephone while the cord/plug assembly is connected, large amounts of sudden, non-constant, and unpredictable force may be placed on the connection between the plug and the connector. These forces may result in momentary open connections or shorts that may disrupt the operation of the telephone. Further, these forces may inflict damage to the connector, the plug, or both. Thus, it is important for the connector to be robust and durable enough to withstand a wide variety and large amount of forces over the life of the device.

FIG. 1 illustrates one prior art connector. The connector includes a unitary insulative housing molded from plastic. The insulative housing includes a thick plastic shell surrounding a receptacle cavity. A set of electrical contacts extends from within the receptacle cavity toward the open front. An integral mounting flange extends from each end of the housing. Each mounting flange has a central mounting hole through which a fastener may be extended to affix the housing to a printed circuit board. In addition, two metal side plates having downward-extending hold-down tabs are inserted through the bottom of the housing to form the inner side surfaces of the receptacle cavity. In use, the hold-down tabs are inserted through the circuit board and soldered in place. Unfortunately, although the mostly-plastic construction is durable enough to withstand strong forces, the profile of the front of the connector is too large to be used in many devices. Thus, a need exists for a rugged connector with a profile and overall size small enough to meet the design requirements of today's electrical devices.

FIG. 2 illustrates another prior art connector. The connector includes an insulative housing, a metal shroud, and an electrical contact assembly. The insulative housing includes a central member and two side members. The metal shroud includes a top plate, two side plates, a discontinuous bottom plate and a plurality of mounting and assembly tabs, including a hold-down tab extending downwardly from each side plate. Each side plate further includes an interlock hole. The shroud fits between the central member and the side members of the insulative housing to form a receptacle cavity. The electric contact assembly includes one or more electrical contacts which are inserted into the insulative housing. The shroud is attached to a printed circuit board by inserting the hold-down tabs through corresponding holes in the circuit board and soldering them in place. The insulative housing is held in place against the shroud by the plurality of mounting tabs. In use, a plug is inserted into the receptacle cavity and held there by spring-loaded locking teeth which are biased through interlock holes in the side plates of the shroud. A connector using a metal shroud instead of mostly-plastic construction is much smaller in profile and overall size than a mostly-plastic connector of equal strength. Unfortunately, when the plug is subjected to typical pulling and bending-type forces, those forces are transferred to the metal shroud through the locking teeth, causing the metal shroud to separate from the insulative housing and from the circuit board. When the shroud and housing separate, the plug may separate from the electrical contacts of the connector. More significantly, the solder joints between the hold-down tabs and the circuit board can also fail. When the hold-down tab solder joints fail, the electric contact assembly is held in place only by the solder connections between the individual electrical contacts and the printed circuit board. Additional forces exerted on the connector are then transferred directly to the electrical contacts. In either case, the electrical connection between the electrical device and the plug may be degraded or even completely disabled. Thus, a need exists for a small connector with greater mechanical and electrical durability characteristics.

Therefore, a need exists for a ruggedized miniature electrical connector assembly having a reduced size while at the same time providing enough strength and durability to withstand the rough treatment to which electrical devices such as portable radio telephones are typically subjected.

SUMMARY

In accordance with the teachings of the present invention, a small ruggedized plug-type electrical connector assembly comprises an insulative housing, an electrical contact assembly, and a stiffening member. The insulative housing comprises a central member, two side members, and two mounting flanges. The stiffening member comprises a shroud and a pair of mounting flanges. The shroud of the stiffening member fits in between the central member and the side members of the insulative housing, and the mounting flanges of the stiffening member are positioned underneath the mounting flanges of the insulative housing. The electric contact assembly comprises one or more electrical contacts which are inserted into the insulative housing. The mounting flanges of both the insulative housing and the stiffening member are fastened to a printed circuit board in a layered arrangement. Finally, one end of each electrical contact is affixed to a corresponding trace on the circuit board. In operation, a plug is inserted into the connector, and the majority of the forces exerted by the plug on the connector are transferred to the circuit board via the shroud, the stiffening member mounting flanges, and the fasteners. In addition, the stiffening member is held in place against the insulative housing by multiple contact points and by fasteners.

Advantageously, the present invention allows an electrical connector to have a small profile and overall size.

Also advantageously, the present invention allows an electrical connector in which a metal shroud remains securely fastened to an insulative housing and to a circuit board.

Also advantageously, the present invention allows a small electrical connector to maintain a stable electrical connection between an electrical device and a plug.

Also advantageously, the present invention allows a small ruggedized connector to be easily manufactured.

Therefore, it can be seen that these aspects of the present invention may be utilized to more reliably mount a small electrical connector to a circuit board or another body. These and other aspects, features and advantages of the present invention will be set forth in the description that follows and possible embodiments thereof, and by reference to the appended drawings and claims.

DETAILED DESCRIPTION

Figure 1:
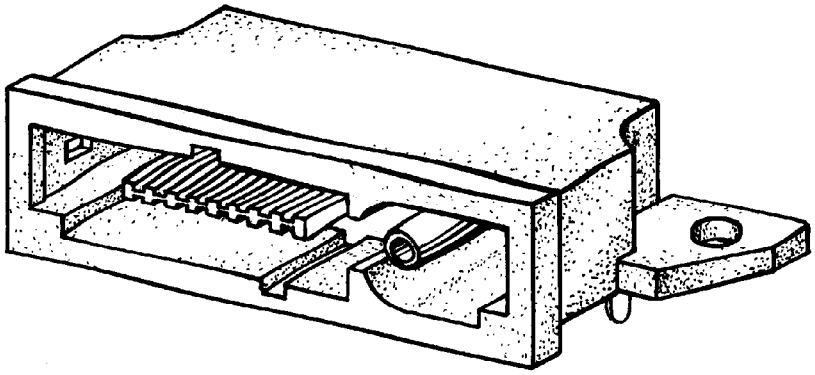
(PRIOR ART) FIG 1
FIG. 1 is a picture of a prior art electrical connector.
Figure 2:
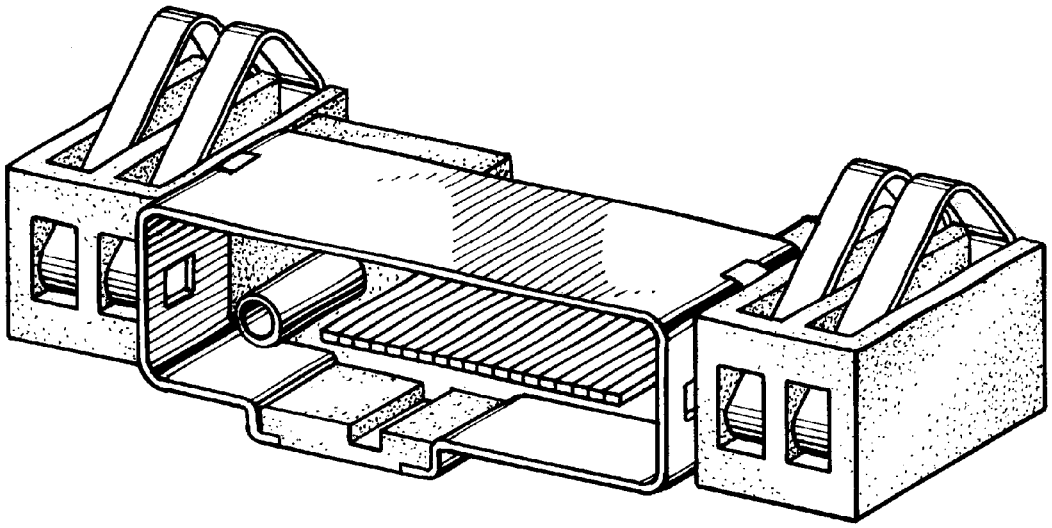
(PRIOR ART) FIG 2
FIG. 2 is a picture of another prior art electrical connector.

Before describing the details of the present invention, it will be appreciated that directional terms such as "top," "bottom," "up," "down" and the like are used herein only to provide a clear and concise description of the invention as viewed in the drawings. The use of such terms herein and in the claims hereof are not intended in any way to be limiting, because it is known that printed circuit board-mounted electrical connectors, as well as the printed circuit boards themselves, are commonly placed in an infinite variety of positions and orientations.

Referring now to the drawings, in which like numerals represent like elements throughout the several figures, aspects of the present invention will now be described.

Figure 3:
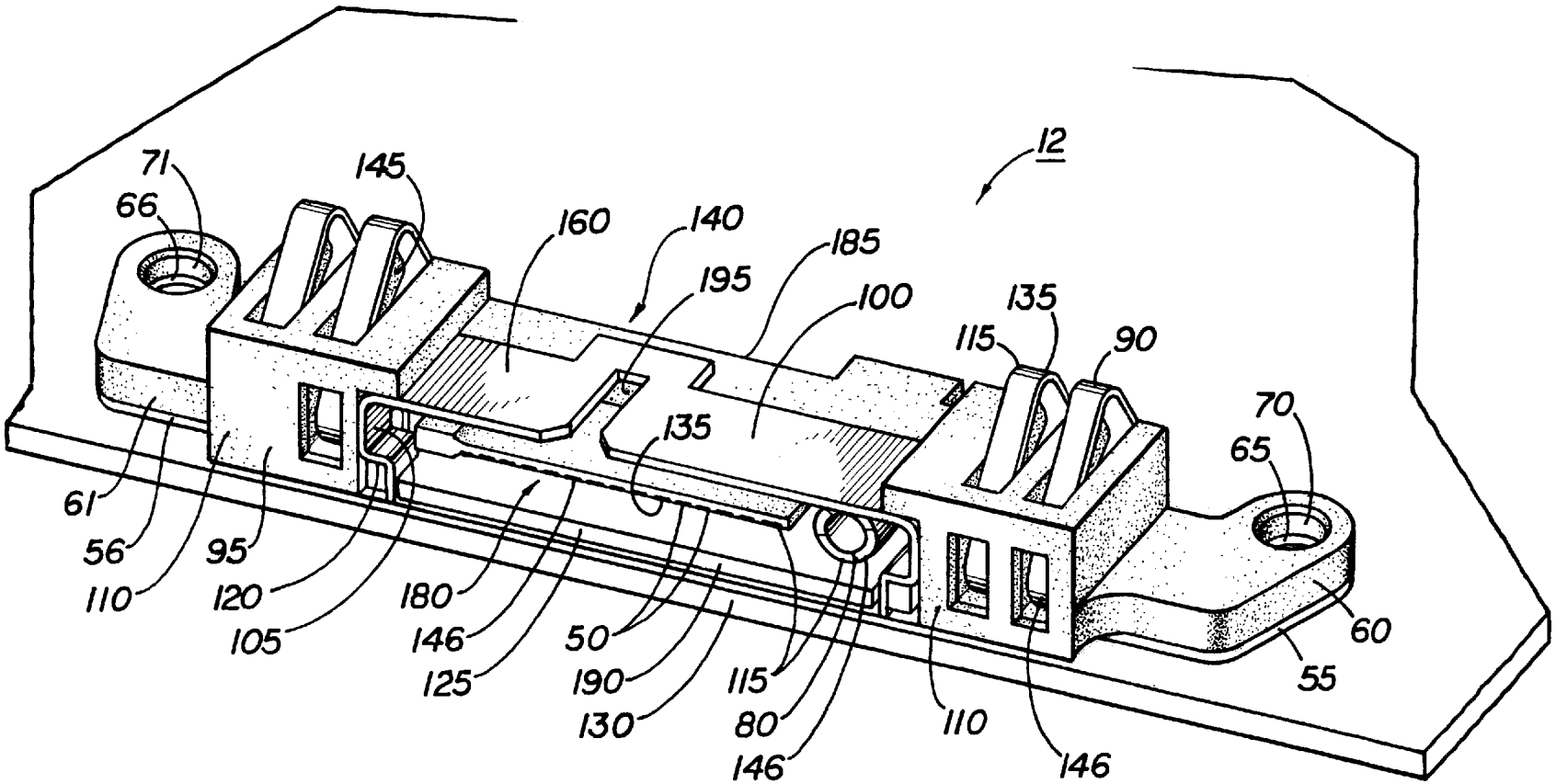
FIG. 3 is a perspective view of the electrical connector assembly of an exemplary embodiment of the present invention.

FIG. 3 is a perspective view of the electrical connector assembly of an exemplary embodiment of the present invention. The purpose of the ruggedized miniature electrical connector assembly 12 is to provide a reliable, temporary electrical connection between a plug (not shown) and a surface, such as a printed circuit board 130 (a "PCB"), of a small electrical device, such as a portable radio telephone. The electrical connector assembly 12 includes an insulative housing 95, an electrical contact assembly 115, and a stiffening member 120.

The insulative housing 95 is made of a material having electrically insulative characteristics. In an exemplary embodiment, the insulative housing 95 is molded of rigid plastic. The insulative housing includes two side members 110 connected by an elongated central member 125. The central member 125 includes a back wall 185 and a bottom plate 190. The back wall 185 includes a front facing plug-side face 195. A plurality of contact receiving passages 140 extend rearwardly through the plug-side face 195 of the back wall 185. One or more battery contact recesses 145 may be located within each side member 110. The insulative housing 95 also includes two mounting flanges 60, 61 extending outwardly from the side members 110 in a direction generally opposite from the central member 125. A housing mounting hole 70, 71 extends downwardly through each mounting flange 60, 61. The mounting flanges 60, 61 are for mounting the electrical connector assembly 12 to the PCB 130 as described below.

The electrical contact assembly 115 includes one or more electrical contacts 135. In the radio telephone exemplary embodiment, the electrical contacts 135 include data contacts 50, a radio frequency ("RF") contact 80 and battery contacts 90. Data contacts 50 are used to receive and transmit bits of data to and from the radio telephone. The RF contact 80 is used to receive and transmit RF signals to and from the radio telephone. The battery contacts 90 are used by a recharging stand to charge the radio telephone's battery. The data contacts 50 and the RF contact 80 extend through the contact receiving passages 140. The battery contacts 90 reside in battery contact recesses 145. Each electrical contact 50 includes a mating portion 146 and a solder tail 150. Devices which are suitable for use as a mating portion include, but are not limited to, a pin, a receptacle, a spring contact, or the like. The mating portions 146 of the data contacts 50 protrude from the plug-side face 195 of the insulative housing back wall 185, and the solder tails 150 of the data contacts 50 protrude from the opposite face of the insulative housing back wall 185 where they may easily be soldered to the PCB 130.

The stiffening member 120 is manufactured from a material having greater strength-to-size characteristics than the plastic from which the insulative housing 95 is molded. In an exemplary embodiment the stiffening member 120 is manufactured from stamped steel. The stiffening member 120 includes a central shroud 100 and two stiffening member mounting flanges 55, 56. The shroud includes two side plates 105 and a top plate 160. The side plates 105 are located at opposite ends of the top plate 160 so that the upper edge of each side plate 105 is connected to one end of the top plate 160. The side plates 105 are oriented substantially perpendicular to the top plate 160 so that the side plates 105 extend downwardly from it. Each side plate 105 includes an assembly tab 170 which is oriented substantially perpendicular to its side plate 105 and extends inwardly underneath the top plate 160.

Figure 4:
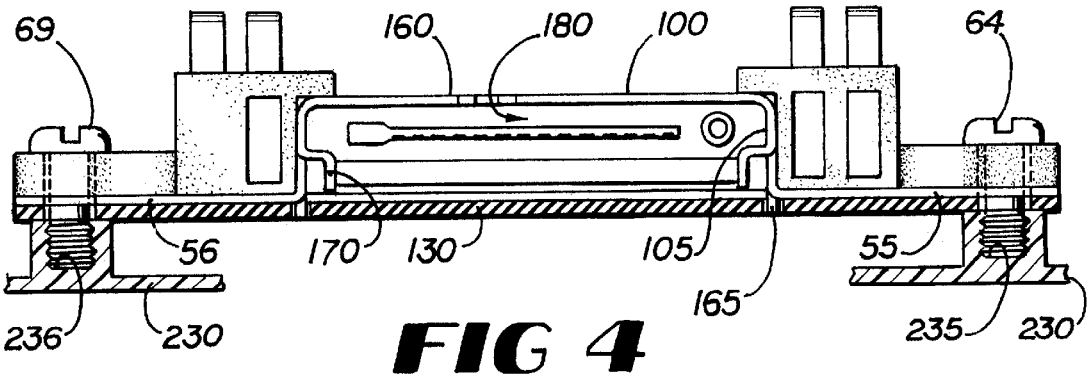
FIG. 4 is a front view of the electrical connector assembly of FIG. 3 with the electrical connector assembly shown mounted on a printed circuit board.

FIG. 4 is a front view of the electrical connector assembly of FIG. 3 with the electrical connector assembly shown mounted on a printed circuit board 130. When assembled with the insulative housing 95 and the electrical contact assembly 115, the shroud 100 is positioned within the recess formed between the insulative housing side members 110 and the insulative housing central member 125, as shown in FIG. 4. Together, the side plates 105 and the top plate 160 of the shroud 100 and the back wall 185 and bottom plate 190 of the insulative housing 95 form a receptacle cavity 180 which surrounds the mating portions 146 of the data contacts 50. The shroud 100 and the insulative housing back wall 185 and bottom plate 190 are of a suitable size and shape to accommodate the insertion and snug retention of the plug in the receptacle cavity 180. Although in the exemplary embodiment illustrated in FIG. 4 the shroud's top plate 160, side plates 105 and side plate assembly tabs 170 surround the plug almost completely when the plug is inserted into the receptacle cavity 180, those of ordinary skill in the art will appreciate that the shape of the shroud 100 may be modified significantly to surround the plug more or less completely without exceeding the scope of the present invention.

Figure 5:
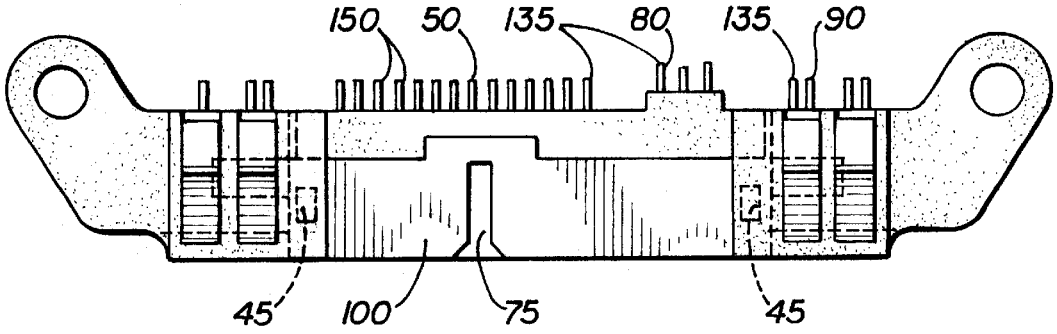
FIG. 5 is a top view of the electrical connector assembly of FIG. 3.
Figure 6:
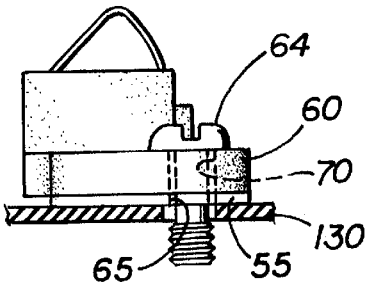
FIG. 6 is a side view of the electrical connector assembly of FIG. 3 with the electrical connector assembly shown mounted on a printed circuit board.

FIGS. 5 and 6 are top and side views, respectively, of the electrical connector assembly 12 of FIG. 3 with the electrical connector assembly 12 shown mounted on a printed circuit board 130. As shown, one stiffening member mounting flange 55, 56 is connected to the lower edge of each side plate 105. Each mounting flange 55, 56 is oriented substantially perpendicular to its side plate 105 and extends outwardly away from the shroud 100. Stiffener mounting holes 65, 66 relatively corresponding in size and location to the housing mounting holes 70, 71 extend downwardly through the mounting flanges 55, 56. The stiffener mounting holes 65, 66 correspond in size to the housing mounting holes 70, 71 and the stiffener mounting holes and the housing mounting holes are positioned so that a first fastener 64 may be inserted through holes 65 and 70 and a second fastener 69 may be inserted through holes 66 and 71 to secure the electrical connector assembly 12 to the PCB 130. When fastened as described, the lamination effect of the insulative housing mounting flanges 60, 61 coupled to the stiffening member mounting flanges 55, 56 imparts additional strength to the combined flanges.

In addition, each side plate 105 includes a hold-down tab 165. Each hold-down tab 165 is co-planar with the side plate 105 of which it is a part, and each hold-down tab 165 protrudes beneath the plane in which the horizontal mounting flanges 55, 56 lie. The top plate 160 also includes a pair of interlock holes 45. Each interlock hole 45 is of a size suitable for mating with a locking tooth of an outwardly-biased spring-loaded latch (not shown) mounted on the plug. The top plate 160 also includes a keyway 75 cut into the front of the top plate 160 and extending toward the back. The keyway 75 is of a size suitable for mating with a corresponding key structure (not shown) on the plug. The operation of the interaction between the latches and the interlock holes 45 and the interaction between the keyway 75 and the plug will be described below.

Figure 7:
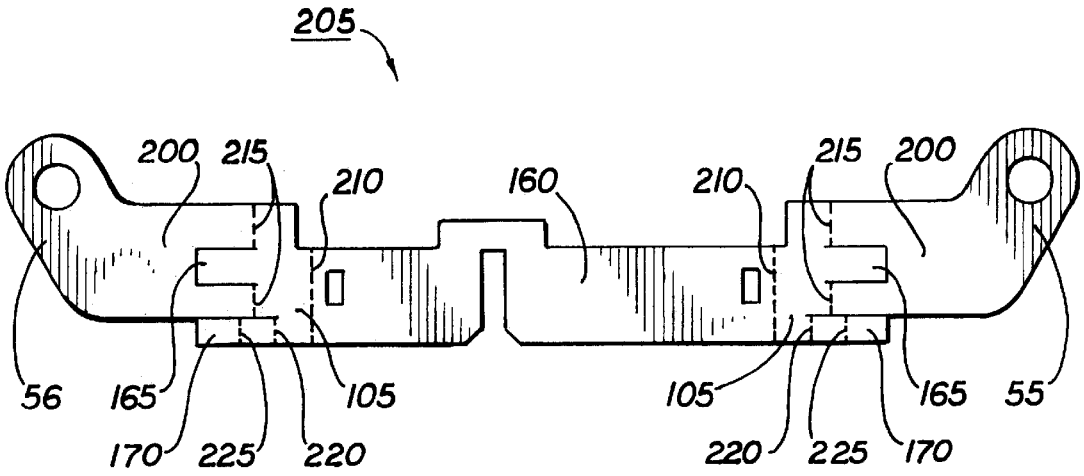
FIG. 7 is a top view of a stiffening member blank for use in the present invention.

FIG. 7 is a top view of a stiffening member blank 205 for use in the present invention. As mentioned previously, in an exemplary embodiment the stiffening member 120 is made out of stamped steel. In an exemplary method of manufacturing the stiffening member 120, a sheet of steel is first stamped to produce the stiffening member blank 205 of the desired size and shape. In an exemplary embodiment, the size and shape are chosen so that the profile of the finished stiffening member 120 when viewed from above is generally similar to the profile of the insulative housing 95 when viewed from above, as best illustrated in FIG. 5. However, it will be appreciated that modifications may be made which affect the overhead profile of either the stiffening member 120 or the insulative housing 95 without exceeding the scope of the present invention.

Figure 8:
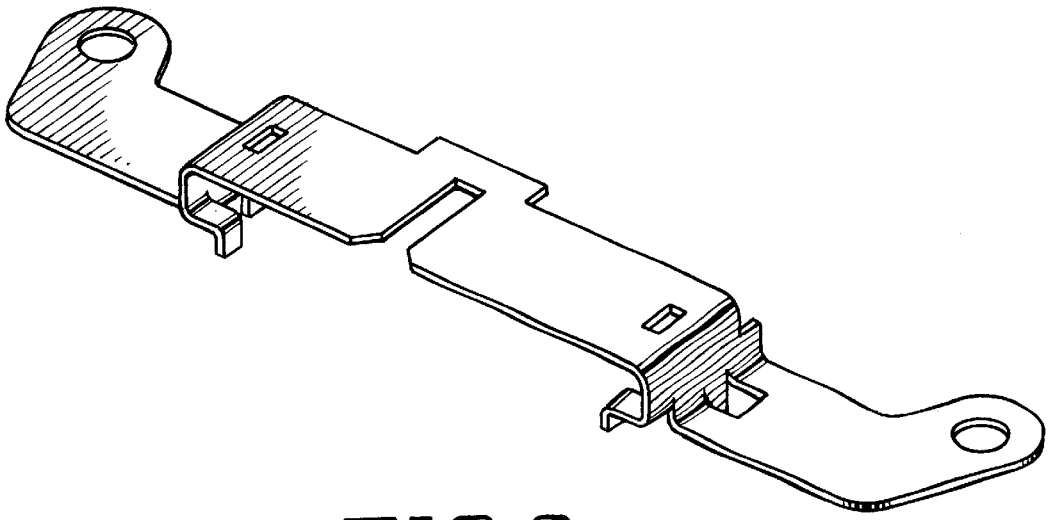
FIG. 8 is a perspective view of an exemplary stiffening member blank after executing the steps of the exemplary method of manufacturing of the present invention.

In the next step of the exemplary method of manufacturing, the ends of the stiffening member blank 205 are bent down along first fold lines 210, thus forming the top plate 160 and two end members 200. Portions of each mounting flange 55, 56 are cut out to form the hold-down tab 165 and assembly tab 170 described above. The outermost portions of the end members 200 are bent outward along second fold lines 215, thus forming the side plates 105 and the stiffening member mounting flanges 55, 56. By cutting out the hold-down tabs 165 from their respective end members 200 before bending the mounting flanges 55, 56 outward along the second fold lines 215, the hold-down tabs 165 are allowed to remain co-planar with the rest of the side plate 105. The assembly tabs 170 are bent inward from the side plate 105 along third fold lines 220. An additional bend along fourth fold lines 225 may also be applied to the assembly tab 170 in order to make it easier to assemble the stiffening member 120 with the insulative housing 95, as described below. FIG. 8 is a perspective view of an exemplary stiffening member blank 205 after performing the above-listed steps.

The components of the electrical connector assembly 12 are then assembled as follows. The stiffening member 120 is inserted within and underneath the insulative housing 95 in the following manner. The shroud 100 is inserted into the recess formed between the side members 110 and the back wall 185 and bottom plate 190 of the central member 125. The assembly tabs 170 are provided to aid in positioning the shroud 100 in place relative to the central member 125, thereby guiding the side plates 105 of the stiffening member 120 into place adjacent to the side members 110 of the insulative housing 95. In addition, the stiffening member mounting flanges 55, 56 are positioned to abut the undersides of the housing mounting flanges 60 in a layered arrangement, as previously described. Also, the stiffener mounting holes 65, 66 are aligned with the housing mounting holes 70, 71. When assembled, the shroud 100 and the central member 125 form a receptacle cavity 180 which is enclosed on the top and sides by the stiffening member shroud 100 and on the back and bottom by the back wall 185 and bottom plate 190, respectively, of the insulative housing central member 125.

In the next step of the exemplary method of manufacturing, the electrical contacts 135 are inserted into the insulative housing 95 in the following manner. The data contacts 50 and RF contact 80 are inserted through the contact receiving passages 140 of the central member back wall 185 such that the mating portions 146 extend underneath and parallel to the shroud portion 100. The battery contacts 90 are placed into the battery contact recesses 145 in such a way that they protrude above the upper surface of the insulative housing 95.

Once assembled, the electrical connector assembly 12 is attached to the PCB 130 in the following manner. The hold-down tabs 165 are inserted through corresponding holes in the PCB 130 and soldered in place. The mounting holes 65, 66 and 70, 71, of the stiffening member 120 and the insulative housing 95, respectively, are positioned over corresponding holes in the PCB 130. A first fastener 64 may then be inserted through holes 65 and 70 and into a first corresponding hole in the PCB 130, and a second fastener 69 may be inserted through holes 66 and 71 and into a second corresponding hole in the PCB 130 to secure the electrical connector assembly 12 to the PCB 130. Once the electrical connector assembly 12 is mounted on the PCB, the solder tails 150 of the electrical contacts 135 become interconnectable with respective conductive traces 175 on the PCB. Any known method may be used to electrically connect the solder tails 150 to the traces 175. One method suitable for electrically connecting the solder tails 150 to the traces 175 is to solder the solder tails 150 directly to the traces 175.

In operation, a plug may be engaged with the electrical connector assembly 12 of the present invention as follows. In an exemplary embodiment, the plug comprises one or more plug contacts, a key structure and a pair of latches. The plug may be inserted into the receptacle cavity 180 by aligning the key structure of the plug with the keyway 75 in the top plate of the stiffening member 120 and gently sliding the plug into the receptacle cavity 180. The interaction between the key structure and the keyway 75 helps to prevent the plug from being misaligned with the electrical contact assembly 115, thus preventing damage to the electrical contacts 135 and the plug contacts.

As described previously, in an exemplary embodiment, the plug includes a pair of outwardly-biased spring-loaded latches. Each of the latches includes a locking tooth. The locking teeth on the latches are arranged to mate with the interlock holes 45 in the top plate 160 of the shroud 100 when the plug is properly seated in the receptacle cavity 180. Each locking tooth is beveled on one edge and square on the opposite edge. The edges of the teeth are arranged so that as the plug is being inserted into the receptacle cavity, the beveled edge is the leading edge and the square edge is the trailing edge. As the plug is inserted into the receptacle cavity 180, the leading edge encounters the front edge of the top plate 160. Because the leading edge is beveled, the teeth, and hence the latches, are caused to be deflected inwardly by the contact with the top plate 160 front edge. The plug may then be fully inserted into the receptacle cavity 180. As the plug reaches the fully-inserted position, the teeth reach a position directly adjacent the interlock holes 45. The latches are then free to spring outward to their naturally biased position so that the locking teeth extend through the interlock holes 45. Once the teeth are properly seated within the interlock holes 45, the square edges of the teeth prevent the plug from being removed from the receptacle cavity 180 without forcing the locking teeth inward. Thus, in order to remove the plug, each tooth must be manually depressed in order to release the tooth from the interlock hole 45.

The transference of forces in an installed electrical connector assembly 12 is described next. In an exemplary embodiment, the PCB 130 on which the electrical connector assembly 12 is mounted is installed in a small, portable radio telephone. The PCB 130 is enclosed by the shell 230 of the radio telephone. The fasteners 64, 69 may be threaded screws which extend through the mounting flange holes 65, 66 and 70, 71, through the holes in the PCB 130 and into correspondingly threaded holes 235, 236 built into the radio telephone shell 230. The electrical connector assembly is mounted on the PCB 130 in such a way that the electrical connector assembly 12 extends through the shell 230 of the radio telephone so that a plug may be connected to it. The plug is attached to the end of an electrical cable or cord. In use, the radio telephone is moved frequently as the user adjusts it to a more convenient location. This movement creates tension on the cord, which in turn exerts force on the plug. A substantial amount of this force is then transferred through the locking teeth to the interlock holes 45 in the shroud 100. Additional forces are imparted to the side plates 105 and top plate 160 of the shroud 100. The forces placed on the shroud 100 tend to pull the shroud 100 away from the insulative housing 95 and from the PCB 130. However, these forces are resisted in several ways. First, the insulative housing 95 itself provides some resistance, but the strength of the insulative housing 95 by itself would be easily overcome by the forces from the plug. Second, the solder connections between the hold-down tabs 165 and the PCB 130 provides a substantial amount of resistance, but the unpredictable nature of the forces on the plug tends to cause the solder connections to break down, allowing the shroud 100 to loosen from the PCB 130. Thus, the most important resistance is provided by the mounting flanges 55, 56 and 60, 61. Forces placed on the shroud 100 are transferred to the stiffening member mounting flanges 55, 56. The lesser forces placed on the insulative housing 95 are transferred to the insulative housing mounting flanges 60, 61. The fasteners 64, 69 inserted through the mounting flanges 55, 56 and 60, 61 and the PCB 130 securely fasten the mounting flanges 55, 56 and 60, 61 to each other and to the PCB 130. Thus, the majority of the forces placed on the stiffening member 120 are transferred to the rigid connections between the mounting flanges 55, 56 and 60, 61 and the PCB 130 rather than the more fragile solder joints or to the insulative housing 95. Finally, in the exemplary embodiment, the fasteners 64, 69 further transfer the forces to the shell 230 of the device itself via the integral corresponding holes 235, 236 in the shell 230.

From the foregoing description, it will be appreciated that the present invention provides an electrical connector having a smaller profile than conventional connectors but capable of withstanding the heavy forces typically applied to such connectors when used in a typical application such as a portable radio telephone. Although the present invention has been described using various examples, it will be appreciated that the present invention is not limited by these examples.

The present invention may be implemented and embodied in a variety of devices and implemented in a variety of materials. The specification and the drawings provide an ample description of the features and operations of the present invention to enable one of ordinary skill in the art to implement the various aspects of the present invention.

The present invention has been described in detail with particular reference to exemplary embodiments. It is understood that variations and modifications can be effected within the spirit and scope of the invention, as described herein before, and as defined in the appended claims. The corresponding structures, materials, acts, and equivalents of all means or step plus function elements in the claims below are intended to include any structure, material, or acts for performing the functions in combination with other claimed elements as specifically claimed.

What is claimed is:

1. An electrical connector assembly for mounting to a body, the electrical connector comprising:

(a) an insulative housing made of a first material, the housing comprising a central member, a plurality of side members, and a plurality of mounting flanges;

(b) an electrical contact assembly, the electrical contact assembly comprising one or more electrical contacts extending through the central member of the insulative housing; and (c) a stiffening member for transferring forces from a plug to the body, wherein the stiffening member is made of a second material, and wherein the stiffening member comprises:

a shroud positioned between the side members of the insulative housing; and a plurality of mounting flanges connected to the shroud, the plurality of mounting flanges of the stiffening member positioned directly underneath the plurality on mounting flanges of the housing.

2. The electrical connector assembly of claim 1 wherein a first mounting flange of the plurality of mounting flanges is positioned at a first end of the shroud, and wherein a second mounting flange of the plurality of mounting flanges is positioned at a second end of the shroud, the second end of the shroud being generally opposite the first end.

3. The electrical connector assembly of claim 1 wherein the one or more electrical contacts include:

(a) a data contact for communicating one or more bits of data through the electrical connector assembly;

(b) an RF contact for communicating a radio frequency signal through the electrical connector assembly; and (c) a battery contact for transmitting an electrical current for a rechargeable battery through the electrical connector assembly.

4. The electrical connector assembly of claim 1 wherein the insulative housing comprises a plurality of mounting flanges, and wherein each of said plurality of mounting flanges is layered adjacent a corresponding one of the plurality of stiffening member mounting flanges.

5. The electrical connector assembly of claim 4 wherein each of the plurality of insulative housing mounting flanges is fastened to the corresponding one of the plurality of stiffening member mounting flanges.

6. The electrical connector assembly of claim 4 wherein the size and shape of each of the plurality of insulative housing mounting flanges is substantially similar to the size and shape of the corresponding one of the plurality of stiffening member mounting flanges.

7. A portable radio telephone comprising:

(a) a printed circuit board;

(b) a telephone shell enclosing the printed circuit board; and (c) an electrical connector assembly extending through the telephone shell, and wherein the electrical connector assembly comprises:

an insulative housing made of a first material, wherein the insulative housing comprises a central member, a plurality of side members, and a plurality of mounting flanges;

an electrical contact assembly, the electrical contact assembly comprising one or more electrical contacts extending through the insulative housing central member; and a stiffening member made of a second material, wherein the stiffening member comprises a shroud positioned between the plurality of insulative housing side members and a plurality of mounting flanges positioned directly underneath the plurality of insulative housing mounting flanges;

wherein the stiffening member mounting flanges are fastened to the insulative housing mounting flanges and the printed circuit board.

8. The portable radio telephone of claim 7, further comprising a plurality of fasteners, wherein the stiffening member mounting flanges are fastened to the insulative housing mounting flanges and the printed circuit board by the plurality of fasteners, and wherein the stiffening member mounting flanges are further fastened to the telephone shell by the plurality of fasteners.

9. An electrical connector assembly for laterally mounting to a body, the electrical connector comprising:

(a) an insulative housing made of a first material, the housing comprising a central member, a plurality of side members, and a plurality of mounting flanges;

(b) an electrical contact assembly, the electrical contact assembly comprising one or more electrical contacts extending through the control member of the insulative housing and electrically coupled to the body; and (c) a stiffening member for transferring forces from a plug to the body, wherein the stiffening member is made of a second material, and wherein the stiffening member comprises:

a shroud positioned between the side member of the insulative housing; and a plurality of mounting flanges connected to the shroud, the plurality of mounting flanges of the stiffening member positioned directly underneath the plurality of mounting flanges of the housing.

10. The electrical connector assembly of claim 9 wherein a first mounting flange of the plurality of mounting flanges is positioned at a first end of the shroud, and wherein a second mounting flange of the plurality of mounting flanges is positioned at a second end of the shroud, the second end of the shroud being generally opposite the first end.

11. The electrical connector assembly of claim 10 wherein the size and shape of each of the plurality of insulative housing mounting flanges is substantially similar to the size and shape of the corresponding one of the plurality of stiffening member mounting flanges.

12. The electrical connector assembly of claim 9 wherein the one or more electrical contacts include:

(a) a data contact for communicating one or more bits of data through the electrical connector assembly;

(b) an RF contact for communicating a radio frequency signal through the electrical connector assembly; and (c) a battery contact for transmitting an electrical current for a rechargeable battery through the electrical connector assembly.

13. The electrical connector assembly of claim 9 wherein the insulative housing comprises a plurality of mounting flanges, and wherein each of said plurality of mounting flanges is layered adjacent a corresponding one of the plurality of stiffening member mounting flanges.

14. The electrical connector assembly of claim 13 wherein each of the plurality of insulative housing mounting flanges is fastened to the corresponding one of the plurality of stiffening member mounting flanges.

15. An electrical connector assembly for laterally mounting to a body, the electrical connector being receptive of a plug that is inserted into the connector on a substantial parallel plain to the body, the electrical connector comprising:

(a) an insulative housing made of a first material, the housing comprising a central member, a plurality of side members, and a plurality of mounting flanges, and being receptive of the plug;

(b) an electrical contact assembly, the electrical contact assembly comprising one or more electrical contact extending through the central member of the insulative housing; and (c) a stiffening member for transferring forces from the plug to the body, wherein the stiffening member is made of a second material, and wherein the stiffening member comprises:

a shroud positioned between the side member of the insulative housing; and a plurality of mounting flanges connected to the shroud, the plurality of mounting flanges of the stiffening member positioned directly underneath the plurality of mounting flanges of the housing.

16. The electrical connector assembly of claim 15 wherein a first mounting flange of the plurality of mounting flanges is positioned at a first end of the shroud, and wherein a second mounting flange of the plurality of mounting flanges is positioned at a second end of the shroud, the second end of the shroud being generally opposite the first end.

17. The electrical connector assembly of claim 15 wherein the one or more electrical contacts include:

(a) a data contact for communicating one or more bits of data through the electrical connector assembly;

(b) an RF contact for communicating a radio frequency signal through the electrical connector assembly; and (c) a battery contact for transmitting an electrical current for a rechargeable battery through the electrical connector assembly.

18. The electrical connector assembly of claim 15 wherein the insulative housing comprises a plurality of mounting flanges, and wherein each of said plurality of mounting flanges is layered adjacent a corresponding one of the plurality of stiffening member mounting flanges.

19. The electrical connector assembly of claim 18 wherein each of the plurality of insulative housing mounting flanges is fastened to the corresponding one of the plurality of stiffening member mounting flanges.

20. The electrical connector assembly of claim 18 wherein the size and shape of each of the plurality of insulative housing mounting flanges is substantially similar to the size and shape of the corresponding one of the plurality of stiffening member mounting flanges.

* * * * *